United States Patent [19]

Barzana

[11] Patent Number: 4,699,165

[45] Date of Patent: Oct. 13, 1987

[54] FABRIC-ENGAGING STAKE

[76] Inventor: Ramon Barzana, 2015 SW. 125th Ct., Miami, Fla. 33175

[21] Appl. No.: 844,314

[22] Filed: Mar. 26, 1986

Related U.S. Application Data

[63] Continuation-in-part of Ser. No. 723,842, Apr. 16, 1985, abandoned.

[51] Int. Cl.[4] ..... E04H 15/62; A47G 9/06; A41F 1/00; A47B 97/00

[52] U.S. Cl. ..... 135/118; 5/417; 24/517; 24/559; 52/153; 248/508

[58] Field of Search ..... 135/118, 117, 119, 900, 135/901, 902, DIG. 5, DIG. 9; 5/417, 420; 24/517, 518, 559, 570, 580, 71 TP, 71 SB, 71 R, 150 PP; 52/4, 153, 154; 248/507, 508, 510

[56] References Cited

U.S. PATENT DOCUMENTS

| | | | |
|---|---|---|---|
| 186,271 | 1/1877 | Rickard | 52/154 |
| 712,631 | 11/1902 | Adams . | |
| 1,146,128 | 7/1915 | Brune | 135/118 |
| 1,274,006 | 7/1918 | Clarke et al. | 24/517 |
| 1,773,760 | 8/1930 | Steinbreder | 135/118 |
| 1,897,382 | 2/1933 | Blair | 135/117 X |
| 2,450,815 | 10/1948 | Schultz | 24/132 |
| 2,647,718 | 8/1953 | Disera | 248/361 |
| 2,809,006 | 10/1957 | Jansey | 248/361 |
| 2,840,092 | 6/1958 | Hill | 135/5 |
| 2,889,129 | 6/1959 | Turbeville | 248/361 |
| 2,939,468 | 6/1960 | Boyce | 135/15 |
| 2,971,236 | 2/1961 | Baker | 24/518 X |
| 3,237,904 | 3/1966 | Abruzese | 248/361 |
| 3,241,202 | 3/1966 | Knauft | 24/85 |
| 3,732,878 | 5/1973 | Blankemeyer et al. | 135/15 |
| 4,150,276 | 4/1979 | Moss | 219/70 |
| 4,185,424 | 1/1980 | Streit | 135/118 X |

FOREIGN PATENT DOCUMENTS 24029 of 1911 United Kingdom .

*Primary Examiner*—Robert A. Hafer
*Assistant Examiner*—D. Neal Muir
*Attorney, Agent, or Firm*—Richard M. Saccocio

[57] ABSTRACT

A stake for anchoring a beach blanket, towel or other like fabric is disclosed. An elongated body is provided with tapered vanes. A planar upper end is provided with an arcuate slot within which is located a rotatable ring. A vertical slot, a curved edge and a recess provide for engaging the fabric when the fabric is applied thereto and the ring is rotated into the recess. The arcuate slot allows for downward sliding of the ring into a locking location which may be provided with a detent.

11 Claims, 17 Drawing Figures

24
22
20
24

50
27
41
36
28
30
42
34
38
40
44
32
24
3
3
26
26

26
26
26
26

40
50
41
34
22
42
43
44

40
41
22

42
7
40
22
32

7
41
36
30
28
22
42
34
45
38
40
44
43
44
26

FABRIC-ENGAGING STAKE

CROSS-REFERENCE TO RELATED APPLICATION

This application is a continuation-in-part of United States Patent Application Ser. No. 723,842, filed Apr. 16, 1985, entitled "Fabric-Engaging Stake" by Ramon Barzana now abandoned.

BACKGROUND OF THE INVENTION

1. Field of the Invention

The present invention relates to anchors particularly arranged to retain a blanket, beach towel or the like on the sand of a beach and, in particular, an anchor to which a towel, blanket or the like may be secured in a stationary position on a beach without the use of pins, straps or other such mechanical fastening elements.

The purpose of this invention is to provide means for the anchoring of a sheet of fabric material such as a blanket or beach towel, in a substantially stationary position on a beach or the like without a need for permanently attaching elements to the sheet of fabric thereby causing damage to the fabric.

The maintaining of beach blankets in a stable and stationary position while stretched upon the sand of a beach has always been a problem, particularly when the wind is blowing, this being due to the tendency of the edges and corners of a blanket or towel to roll or turn over when subjected to wind or pedestrians stepping on the edges thereof. Thereby, such blankets will frequently become distorted and, in many instances, become embedded in the sand.

With consideration to the above problems, the present invention contemplates use of an anchoring means for the blanket without need of making of holes in the beach blanket.

2. Description of the Prior Art

Prior art in this area generally falls within three main categories. One being a pin which fits within an opening in the item to be secured and is secured to the ground by means of a protruding or extending head portion of the pin. This action is much like that of an ordinary thumb tack. The second class of anchors comprise the use of a stake having a clip attached to the upper end whereby the clip fastens onto an edge or corner of the towel or blanket. The third category comprises various combinations of the first two categories; for example, a headed stake over which the blanket is placed and then held thereto by a resilient clip which stretches to fit over the covered head of the stake and then closes in around the thinner neck of the stake.

None of the prior art devices operate satisfactorily. They do not firmly grasp the blanket; or, they are clumsy to use; or, they contain loose parts which may become lost; or, the resilient components break; or, they tear or permanently disfigure the blanket. There are additional other undesirable features of such prior art anchors. Accordingly, there exists a need for blanket and/or towel anchors which overcome the problems and deficiencies of the prior art.

With the above in mind, my beach towel-engaging or, more generally, fabric-engaging stake may be viewed as an improvement over the art known in this area.

SUMMARY OF THE INVENTION

The invention constitutes a ground-level fabric-engaging stake, comprising a ground-engaging spike having a plurality of earth penetrating vanes having a fabric-engaging upper end which includes a fabric-engaging radius and one or more fabric- engaging slots. There is further provided a ring secured within an opening in the stake which allows the ring to pivot about an edge of the opening. The ring and the pivot means are proportioned with the fabric-engaging radius to lockingly engage the fabric after it has been placed over the radius, and after the ring has been rotated thereby securing the fabric to the stake. The stake is also provided, in another embodiment, with an arcuate slot about which the ring can pivot and thereafter when the ring is rotated about its edge and over the fabric-engaging radius, is pushed downward to lock the ring in position. The fabric-engaging one or more slots in combination with the fabric-engaging radius provides for even more secure attachment of the blanket. A further feature comprising a detent at one end of the arcuate slot provides for further locking of the ring. Through the usage of one of said fabric-engaging stakes at each corner of a beach blanket, stable securement of the blanket to the beach is accomplished.

It is thereby an object of the present invention to provide an anchoring means for securing a blanket in an outstretched position upon a beach in which the anchoring means are independent of the blanket, prior to its engagement with the four corners of the blanket.

Another object of the present invention is to provide a useful structural refinement in the holders of beach towels, beach blankets, and the like which may be effectively employed for the securement of such objects to the ground without damaging the blanket.

A further object of the present invention is to provide an improvement in the structural arrangement of keeper devices adapted for rapid securement and withdrawal into and from the ground.

A further object of the present invention is to provide a fabric-engagement means having the above advantages and, further, exhibiting simplicity of structure and construction, efficiency in operation, a pleasing appearance, and economy in cost.

The above and yet further objects and advantages of the present invention will become apparent from the hereinafter set forth Detailed Description of the Invention, the Drawings, and the Claims appended herewith.

DETAILED DESCRIPTION OF THE INVENTION

Figures 1, 2, 3, 4, 5, 6, 7:
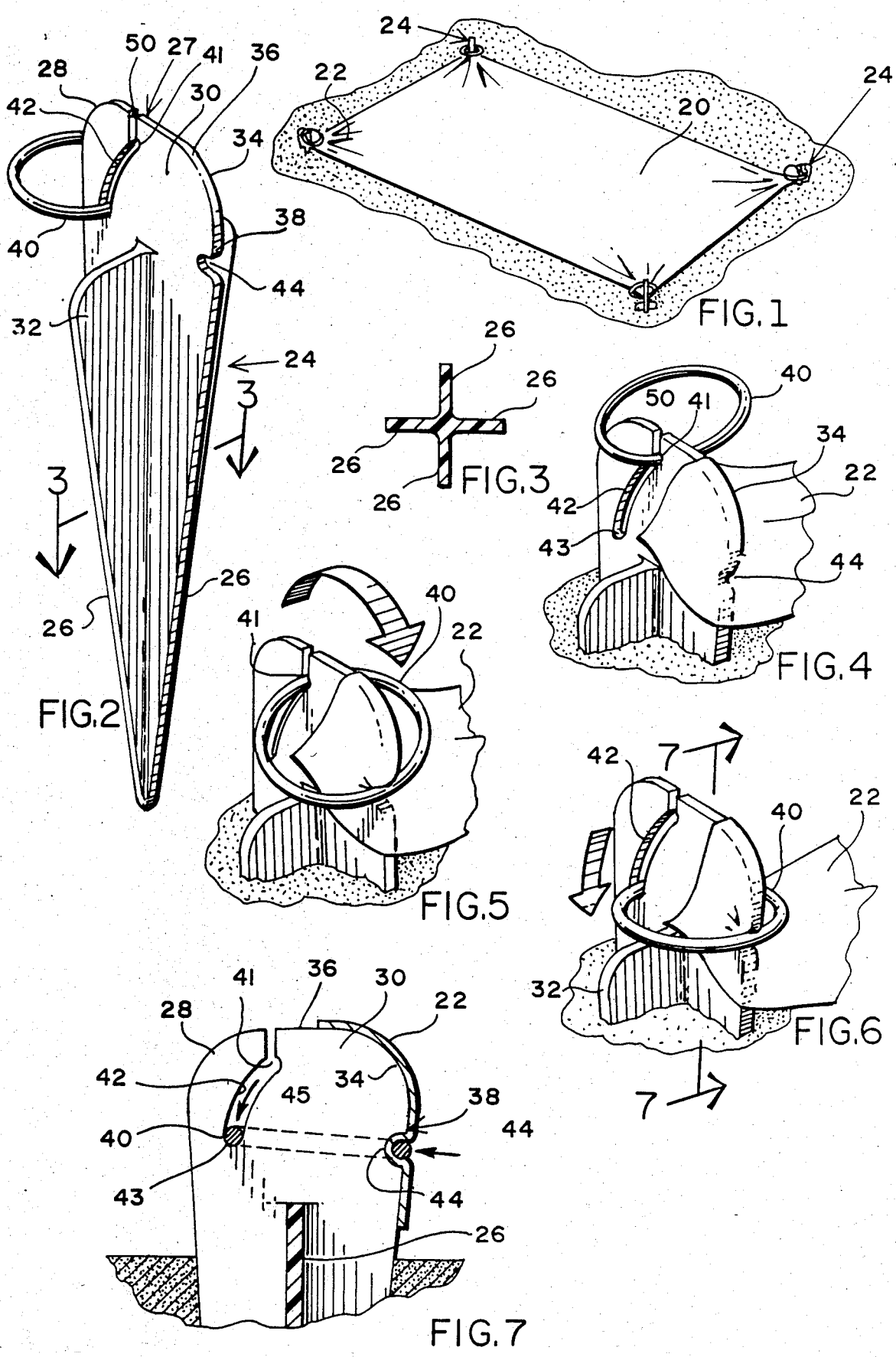
FIG. 1 is a perspective view of a beach blanket or the like secured to a beach in accordance with the usage of the present inventive fabric-engaging stake.
FIG. 2 is a perspective view of one embodiment of the invention.
FIG. 3 is a cross-sectional view taken along line 3—3 of FIG. 2.
FIG. 4 is a perspective, operational view showing an initial step in usage of the embodiment of FIG. 2.
FIG. 5 is a perspective, operational view showing a subsequent step in usage of the embodiment of FIG. 2.
FIG. 6 is a perspective, operational view showing a final step in the usage of the embodiment of FIG. 2.
FIG. 7 is a longitudinal, cross-sectional view taken along the line 7—7 of FIG. 6.

With reference to FIG. 1, there is shown in perspective view the inventive ground-engaging stake 24 holding beach blanket 20 in place. Also shown are corners 22 of the fabric of beach blanket 20.

In FIG. 2 is shown, in perspective view, one embodiment of the instant invention. Shown therein are a plurality of earth penetrating vanes 26, two of which combine to form upper end 27 of stake 24. Upper end 27 more particularly comprises a first portion 28 and a second portion 30. The relationship of the respective vanes 26 is more particularly shown in the cross-sectional view of FIG. 3 where it is seen that four vanes 26 intersect at substantially right angles relative to each other.

Portion 30 of upper end 27 comprises the fabric-engaging portion of stake 24 and, more particularly, includes a fabric-engaging radius 34 which constitutes the radiused edge of portion 30 of upper end 27 (see FIGS. 2 and 7). The fabric-engaging radius 34 beings at a mid upper part 36 of portion 30 and terminates at a lower end part 38 thereof. Just beyond the lower end 38 of radius 34 is a recess 44.

Within first portion 28 of upper end 27 is a elongated curvilinear or an arcuate slot 42 which, as more fully described below, comprises a pivot means within and about which ring 40 may be rotated.

As may be noted, the curved segment between the beginning end 36 and the terminating end 38 of fabric-engaging radius 34 comprises a rounded corner of substantially one-quarter of a circle.

The operation of the embodiment of FIG. 2 is shown in FIGS. 4 through 6. FIG. 4 shows the initial step in securing the fabric to the stake in the usage of the inventive fabric-engaging stake. Therein, fabric corner 22 is shown pressed against the radius 34 and against recess 44. In this step the ring 40 is disposed toward the upper end 41 of slot 42. Ring 40 may be connected to stake 24 by inserting ring 40 through opening 50 which intersects with slot 42. The size of opening 50 may be slightly less than the thickness of ring 40 so that in accordance with the resilience and flexibility of stake 24 a snap fit exists between ring 40 and opening 50. In this manner ring 40 is effectively secured within slot 42. A sliding fit may exist between ring 40 and slot 42.

The next step in the use of the stake is shown in FIG. 5 wherein ring 40 is shown rotated in the direction of the shaded arrow about the base of slot 42 such that ring 40 is urged over fabric corner 22 and, in the same motion, into recess 44, such that fabric corner 22 is held within recess 44 by virtue of the engagement of ring 40 thereinto.

The next step in the usage of the embodiment of FIG. 2 is shown in FIG. 6 and, as well, in the cross-section view of FIG. 7, wherein the side of ring 40, opposite to the side held within recess 44, is rotated downward, in the direction shown by the shaded arrow in FIG. 6 to thereby place ring 40 into lock point 43 of slot 42 and to further secure the opposited end of ring 40 within recess 44. See particularly FIG. 7.

As may be noted in the views of FIGS. 6 and 7 the pressing of ring 40 into lock point 43 acts to lockingly engage the fabric 22 against the radius 34 of portion 30 of the stake. It has been found that sufficient pressure is thereby applied to the fabric at the recess 44 to hold fabric corner 22 in place. In order to accomplish such locking, the distance between recess 44 and locking point 43 should approximately equal the internal diameter of ring 40. The thickness of fabric 20 then serves to effectuate a force fit of ring 40 between lock point 43 and recess 44 which is allowed by the inherent slight amount of resiliency of ring 40.

Through the views of FIGS. 2 through 7, it may be appreciated that said slot 42 having a ring pivoting base 45 defines a multiplicity of possible pivot points, each disposed at a different distance from any particular point of said fabric-engaging radius 34. Therein, said ring and said slot are proportioned with said fabric-engaging radius to lockingly engage the fabric after said fabric has been caused to overlie said radius (FIG. 4), after said ring has been rotated around said radius (FIG. 5), and after said ring has been pressed into lock point 43 (FIGS. 6 and 7).

Figure 8:
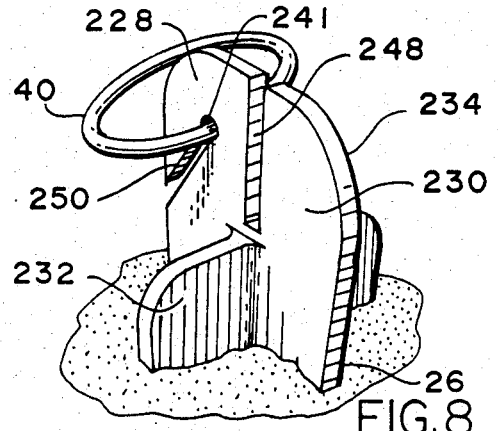
FIG. 8 is a perspective view of a second embodiment of the present inventive fabric-engaging stake, showing an initial step in the usage thereof.

Shown in FIG. 8 is a second embodiment of the present invention wherein it may be seen that recess 44 has been eliminated, while an elongated fabric-engaging vertical opening 248 having an axis substantially co-directional with the longitudinal axis of the stake has been provided. As may be appreciated from the operational views of FIGS. 9, 10 and 11, said opening 248 has been proportioned to accept areas of fabric corner 22 not otherwise secured between ring 40 and fabric-engaging radius 234. In the longitudinal cross-sectional view in FIG. 11, the end portion 222 of fabric corner 22 is shown pressed within longitudinal vertical opening 248.

The embodiment of FIG. 8 otherwise differs from the embodiment of FIG. 2 in that linear slot 250 in conjunction with the rounded opening 241 at the end thereof serves to connect the ring to the stake and to allow rotating of the ring. Slot 250 is, more particularly, an elongated, resilient slot capable of press-fittingly accepting ring 40 (similar to opening 50) and, thereby, permitting said ring to be slid or urged to the rounded open end 241 of linear slot 250 and, thereby, into a pivot axis which is mechanically isolated from the press-fit, sliding, linear path of slot 250 (which is similar to the relationship of opening 50 and curved slot 42). Thereby, ring 40, once "popped" into end 241 of linear slot 250 will be rotationally locked thereinto, such that the only further movement of ring 40 will be about the pivot axis defined by end 241.

Figure 9:
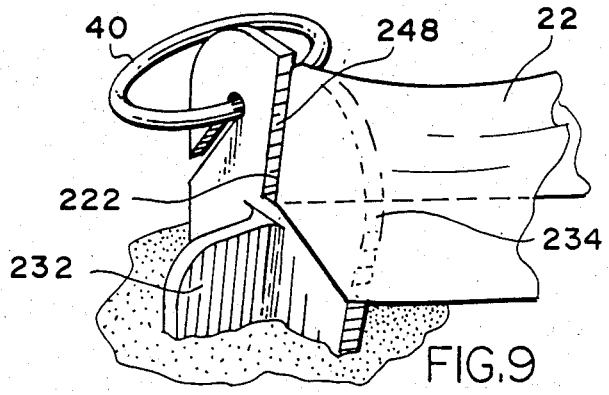
FIG. 9 is a perspective, operational view illustrating a subsequent step in the usage of the embodiment of FIG. 8.
Figure 10:
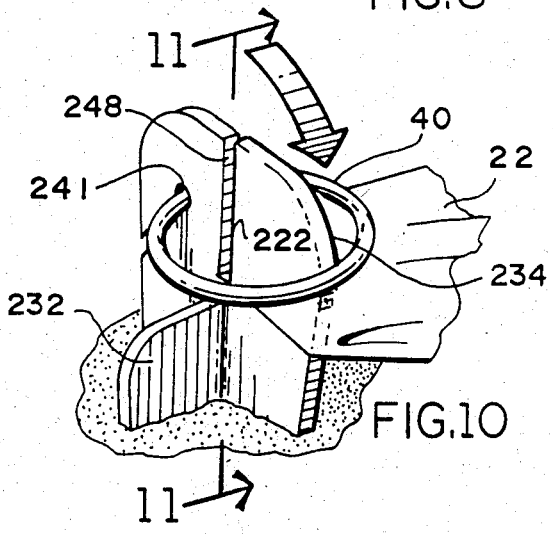
FIG. 10 is perspective view showing a final step in the usage of the embodiment of FIG. 8.
Figure 11:
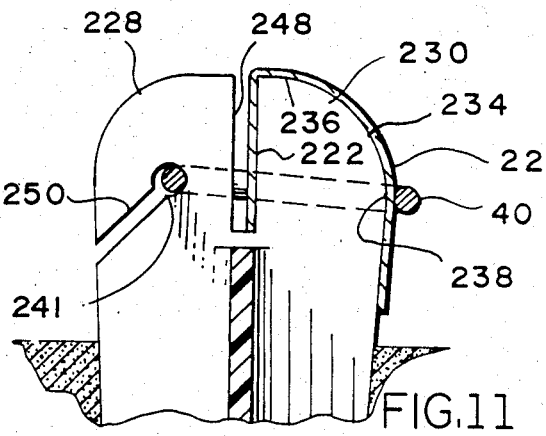
FIG. 11 is a longitudinal, cross-sectional view taken along line 11—11 of FIG. 10.

The practical consequence of the above, with reference to the embodiment of FIG. 8, is shown in the operational views of FIGS. 9, 10 and 11. More particularly, in FIG. 9, the end portion 222 of fabric corner 22 is shown pressed into vertical notch 248. Additionally, the rest of fabric corner 22 is placed over fabric-engaging radius 234.

In FIGS. 10 and 11 ring 40 is shown rotated, in the direction of the shaded arrow, over fabric corner 22 and over radius 234 such that the combination of forces created by (a) the friction engagement of the walls of vertical notch 248 with end 222 of fabric corner and (b) the line of force created by rounded end 241 comprising a lock point (similar to lock point 43), which holds ring 40 within stake 228 and the pressure fit engagement of ring 40 at the terminating end 238 of radius 234, will secure fabric corner 22 against dislodgement from the stake and, thereby, will secure the fabric corner.

Figure 12:
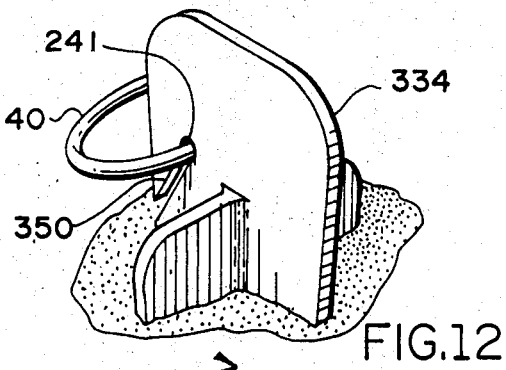
FIG. 12 is a perspective view of a third embodiment of the present invention showing an initial step in the usage thereof.
Figure 13:
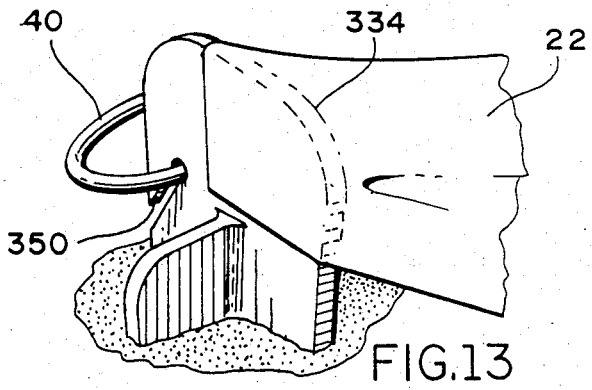
FIG. 13 is a perspective, operational view of the embodiment of FIG. 11 showing a subsequent step in the usage thereof.
Figure 14:
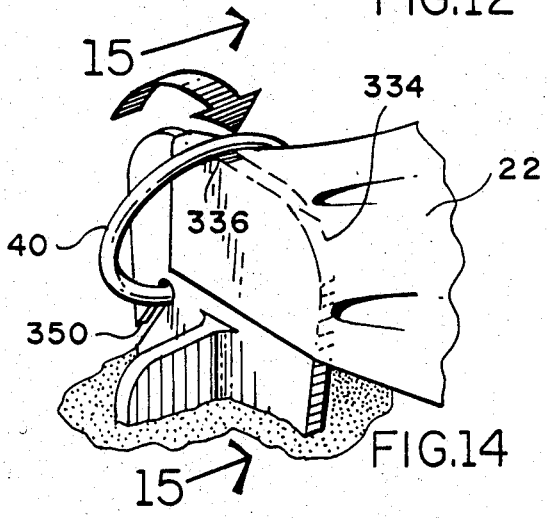
FIG. 14 is a perspective, operational view of the embodiment of FIG. 12 showing a final step in the usage thereof.
Figure 15:
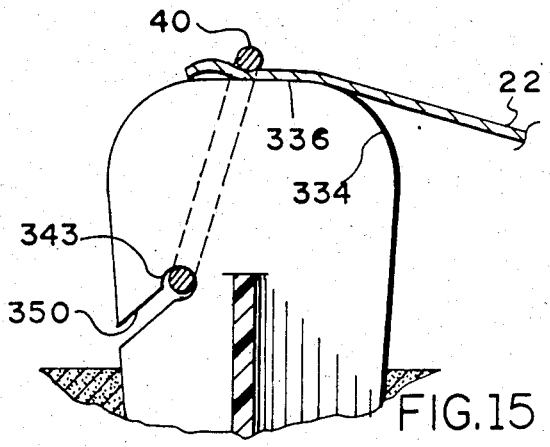
FIG. 15 is a longitudinal, cross-sectional view taken along the line 15—15 of FIG. 14.

In FIGS. 12 through 14 is shown a third embodiment of the inventive fabric-engaging stake. The embodiment of FIG. 12 differs from the embodiment of FIG. 2 in its elimination of recess 44 and, in addition, in its usage of a linear slot 350 similar to that of the second embodiment and, as well, in its usage of a combination pivotal and lock point 341 in the upper end of slot 350 which dimensionally and functionally act similar to slot 250 and pivotal and lock point 241.

With reference to FIG. 13, the first step of the usage of the embodiment of FIG. 12 is the placement of fabric corner 22 over the radius 334 of the embodiment of FIG. 12. Thereafter, ring 40 is rotated about pivot point 341 and is frictionally secured against fabric 22 at or beginning end 336 of fabric-engaging radius 334. The rotation of ring 40 is shown by the shaded arrow in the view of FIG. 14. The simple frictional force existing between the beginning end 336 of the fabric-engaging radius and ring 40 has been found sufficient to hold most fabrics.

Figure 16:
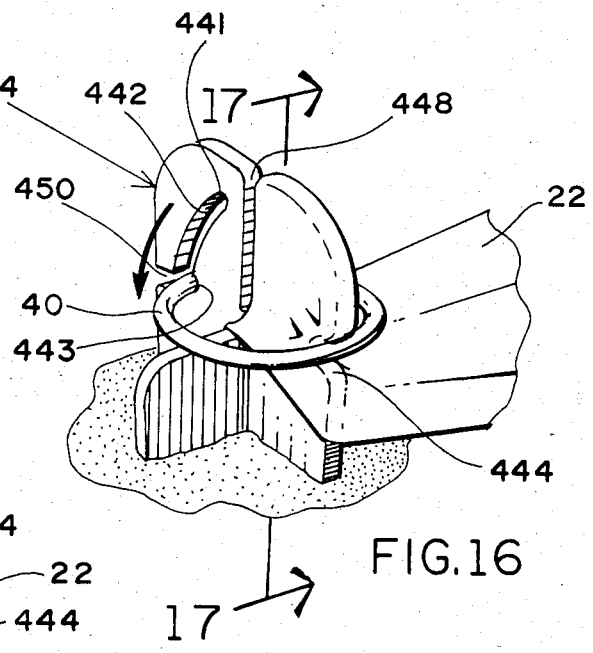
FIG. 16 is a perspective, operational view of the final step in the usage of another embodiment of the invention; and, FIG. 17 is a longitudinal, cross-sectional view taken along the line 17—17 of FIG. 16, illustrating various details of the embodiment of FIG. 16.
Figure 17:
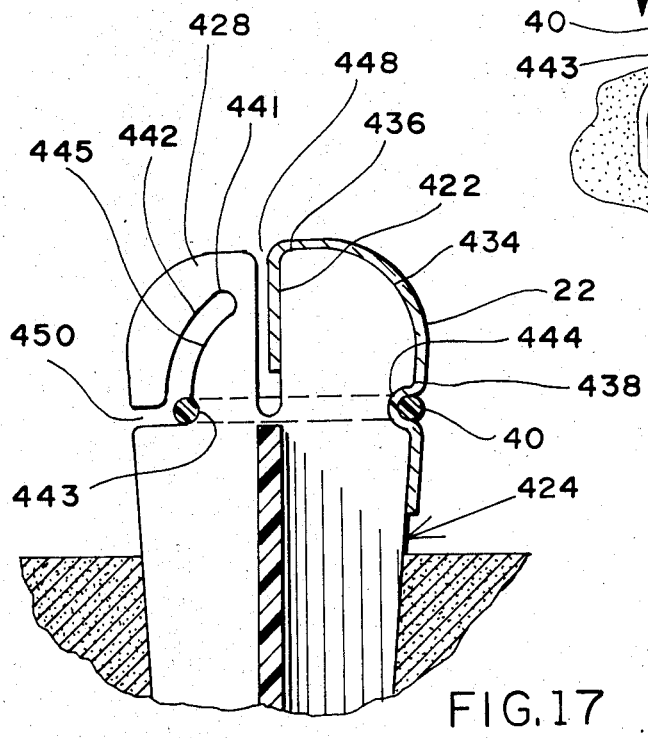

FIGS. 16 and 17 illustrate another embodiment of the present invention. From these figures it may be seen that a vertical fabric-engaging slot 448 and a fabric-engaging notch or recess 444 are used in addition to the fabric-engaging radius 434. And, that a curvilinear or arcuate slot 442 having a pivoting base portion 445 for rotating the ring 40 is provided. There is further provided an opening 450 for allowing connection of ring 40 to the stake 424. There is even further provided another recess 443 at the lower end of curvilinear or arcuate slot 442.

Fabric-engaging radius 434 includes a beginning point 436 and ending point 438 and comprises a rounded corner of substantially one-quarter of a circle. Fabric-engaging radius 434 is thus constructed and serves the same purpose, in the same manner, as rounded corners 34, 234 and 334 of the above embodiments. Also, recess 444 is constructed and serves the same purpose, in the same manner, as recess 44 of the embodiment of FIGS. 1 through 7.

Vertical opening 448 is constructed and positioned as in the embodiment of FIGS. 8 through 11. Accordingly, vertical opening 448 serves the same purpose and, in the same manner, as opening 248.

Opening 450 as noted in FIGS. 16 and 17 is located along a horizontal axis of portion 428 of stake 424 and, thereby, intersects with the lower end of curvilinear slot 442. Opening 450 serves the same purpose and, in the same manner, as openings 50, 250, and 350, notwithstanding the different locations. Opening 450 thereby comprises an elongated resilient slot capable of press-fittingly accepting ring 40 and thus permits ring 40 to be slid or urged into curvilinear slot 442 and effectively secured therewithin. Ring 40 is slidingly and pivotingly engaged within curvilinear slot 442 which also functions as a pivoting means for the rotation of ring 40. Ring 40, once "popped" into slot 442, cannot, therefore, be removed from slot 442 without the application of forces equal and opposite to those used during installation.

Slot 442 comprises a curvilinear or arcuate opening whereby the distance between its pivoting base 445 and recess 444 decreases as slot 442 progresses from the location of opening 450 toward its upper end 441. Conversely, this distance increases as curvilinear slot 442 progresses downward from end 441 toward opening 450. The distance between pivoting base 445 of slot 442 and recess 444 at the location just above opening 450 is substantially equal and perhaps slightly greater than the internal diameter of ring 40. In this manner, when fabric corner 22 is fitted within recess 444, the thickness of fabric 20 causes a force fit between ring 40 and the distance between base 445 and recess 444 at this location and, therefore, the fabric is compressed and securely held within recess 444.

The lower end of the pivoting base surface 445 of curvilinear slot 442 is slightly relieved in a direction toward recess 444 so as to increase the across-the-width size of slot 442 at this location. Also, the distance between the pivoting base surface 445 and recess 444 is slightly less than that at the location just above opening 450. This results in a slight detent in base surface 445 at this location which forms a lock point 443 for ring 40. When one side of ring 40 is lodged within recess 448 together with fabric corner 22 and the opposite side is rotated downward from location 441 in the direction shown by the shaded arrow in FIG. 16, the holding force on the fabric within recess 444 increases and reaches a maximum at the location just above the detent. Continued downward rotation causes the ring 40 to pass into the detent at this location which comprises lock point 443. This causes a slight but negligible decrease in the compressive force on the fabric at recess 444 but, more importantly, causes ring 40 to be resiliently "locked" in place at lock point 443. The decrease in force in negligible because the ring 40 and distance between lock point 443 and recess 444 are proportioned to provide a relatively substantial positive compressive force on the fabric due to the still greater distance between the combined thickness of fabric 20 plus the distance between lock point 443 and recess 444 than the internal diameter of ring 40. The presence of the detent provides a lock point 443 which prevents ring 40, once it is in place, from riding up in slot 442 and, thereby, prevents unintentional loosening of fabric corner 22.

The operational usage of the embodiment of FIGS. 16 and 17 is a combination of the individual operational usages described above for each of the embodiments incorporating the features of the embodiment of FIGS. 16 and 17. Accordingly, it is not necessary to further describe the operational fitting of fabric corner 22 to stake 424 and whereby the fabric is frictionally held onto the stake 424 by the recess 444, the radius 434 and vertical slot 448. Moreover, the ring 40 is more positively held in place in slot 442 because of the lock point configuration of end 443 of slot 442.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. A stake for anchoring a beach blanket, towel or other like fabric comprising an elongated body comprising a plurality of tapered earth-engaging vanes, at least one of said vanes having an upper end extending therefrom to form a planar portion, a fabric engaging curved edge at one end of said planar portion, an arcuate slot through said planar portion and spaced from said curved edge, a ring slidingly and pivotingly engaged within said arcuate slot, a fabric engaging approximately longitudinal slot between said curved edge and said arcuate slot, a fabric-engaging recess at a lower terminating end of said curved edge, said curved edge, arcuate slot, vertical slot, recess, and ring being proportioned whereby said fabric is securely engaged by said stake when said fabric is fitted within said vertical slot, over said curved edge and within said recess and one portion of said ring is rotated over said fabric into said recess and another opposing portion of said ring is slidingly moved within said arcuate slot to a lower end of said arcuate slot.

2. In the stake of claim 1, means for locking said ring in position at the lower end of said arcuate slot.

3. The stake of claim 2, wherein said ring locking means further comprises a detent in the lower end of said arcuate slot at the edge surface thereof located more closely toward the recess at the opposite edge of the planar portion.

4. The stake of claim 3, wherein said detent comprises approximately one-quarter of a circle.

5. The stake of claim 4, wherein the distance of the planar portion between said detent and said recess is slightly less than the inner diameter of said ring whereby when said fabric is fitted within said recess and said ring is locked in place, a compressive force is exerted on said fabric so as to securely engage said fabric within said recess and to said stake.

6. The stake of claim 1, wherein said arcuate slot and said curved edge are oriented such that at one end they converge toward each other and at the other end diverge away from each other.

7. The stake of claim 1, wherein said fabric-engaging curved edge comprises a radius of approximately one-quarter of a circle.

8. In the stake of claim 1, means for permitting engagement of said ring to said arcuate slot comprising an opening from an edge of said planar portion intersecting said arcuate slot, said opening having an across-the-width size slightly smaller than the thickness of said ring.

9. A ground-level, fabric-engaging stake, comprising a ground-engaging spike having a plurality of earth penetrating vanes, an upper end of one of said vanes having a fabric-engaging radius thereon, said radius having a proximal and distal end, and a ring secured by pivot means located within one of said upper ends of said vanes other than said fabric-engaging upper end, said pivot means comprising an elongate curvilinear slot, said ring and said slot proportioned with said fabric-engaging radius to engage the fabric after said fabric has been caused to overlie said radius, and said ring has been rotated around said radius to lock said fabric and ring by rotation of said ring along said elongated curvilinear slot.

10. The fabric-engaging stake as recited in claim 9 in which the distal end of said fabric-engaging radius is defined by a recess capable of press-fit securement of said ring after the fabric overlay of said radius, and fabric engagement within said ring has occurred.

11. The fabric-engaging stake as recited in claim 10 in which said fabric-engaging radius comprises a rounded corner of a substantially right angle.

* * * * *